US008937239B2

(12) United States Patent
Takasaki et al.

(10) Patent No.: US 8,937,239 B2
(45) Date of Patent: Jan. 20, 2015

(54) LIGHT EMISSION CONTROL DEVICE

(75) Inventors: Ryo Takasaki, Hamamatsu (JP); Yoshinori Kusumoto, Hamamatsu (JP); Kazuhiro Arai, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 161 days.

(21) Appl. No.: 13/490,391

(22) Filed: Jun. 6, 2012

(65) Prior Publication Data

US 2013/0098224 A1 Apr. 25, 2013

(30) Foreign Application Priority Data

Oct. 21, 2011 (JP) ..... 2011-232206

(51) Int. Cl.
*G10H 1/02* (2006.01)
*A63J 17/00* (2006.01)

(52) U.S. Cl.
CPC ..... *A63J 17/00* (2013.01)
USPC ..... 84/737

(58) Field of Classification Search
CPC ... A63J 17/00; H05B 37/029; H05B 37/0236; G10H 1/0008
USPC ..... 84/737
See application file for complete search history.

(56) References Cited

U.S. PATENT DOCUMENTS 7,227,075 B2 * 6/2007 Chang et al. ..... 84/645
7,851,687 B2 * 12/2010 Chang et al. ..... 84/464 R
8,697,977 B1 * 4/2014 Lysaght et al. ..... 84/626

FOREIGN PATENT DOCUMENTS

JP 6-55194 7/1994
JP 2002-116761 4/2002
JP 2004-029720 1/2004

OTHER PUBLICATIONS

English machine translation of JP06-55194 filed Jul. 26, 1994 by Yamaha.
English language machine translation of JP2002-116761 filed Apr. 19, 2002 by Kawai Musical Instr Mfg. Co.
English language machine translation of JP2004-029720 filed Jan. 29, 2004 by Yamaha Corp.

* cited by examiner

*Primary Examiner* — Jianchun Qin
(74) *Attorney, Agent, or Firm* — David W. Victor; Konrad Raynes Davda & Victor LLP

(57) ABSTRACT

Provided are a light emitting control device, computer readable memory device, and method to control a light emitter associated with a pad capable of being struck to produce a sound. In response to detecting a striking of the pad, a tone associated with the pad is produced. A level of the tone produced is determined and a level meter brightness is determined based on the determined level of the tone. An output brightness for the light emitter is calculated associated with the struck pad using the determined level meter brightness and a brightness change pattern. The light emitter associated with the pad is controlled according to the determined output brightness.

23 Claims, 9 Drawing Sheets

LIGHT EMISSION CONTROL DEVICE

CROSS-REFERENCE TO RELATED FOREIGN APPLICATION

This application is a non-provisional application that claims priority benefits under Title 35, United States Code, Section 119(a)-(d) from Japanese Patent Application entitled "A LIGHT EMISSION CONTROL DEVICE OF A PERCUSSION INSTRUMENT" by Ryo TAKASAKI, having Japanese Patent Application Ser. No. 2011-232206, filed on Oct. 21, 2011, which Japanese Patent Application is incorporated herein by reference in its entirety.

BACKGROUND OF THE INVENTION

1. Field of the Invention

The present invention relates to light emission control devices including light emission control devices that control illumination modes of a light emitter associated with a pad that is struck to produce a sound.

2. Description of the Related Art

Japanese Patent Application, having unexamined publication number JPH0655194, describes an electronic musical instrument with a level indicator (level meter) formed from eight Light Emitting Diodes (LEDs) that are operated, in a sampling mode to sample external sound, to indicate the level of the external sound sampled. Level meters detect amplitude or level information of inputted tone and control light emission of LEDs according to the detection result to display the level of the inputted tone.

SUMMARY

Provided are a light emitting control device, computer readable memory device, and method to control a light emitter associated with a pad capable of being struck to produce a sound. In response to detecting a striking of a pad, a tone associated with the pad is produced. A level of the tone produced is determined and a level meter brightness is determined based on the determined level of the tone. An output brightness for the light emitter is calculated associated with the struck pad using the determined level meter brightness and a brightness change pattern. The light emitter associated with the pad is controlled according to the determined output brightness.

Further provided is a light emission control device that controls a light emission device that causes a light emitter to illuminate. A level information acquiring device acquires level information according to the level of sound. A playback start information acquiring device acquires playback start information indicative of start of playback of sound. A setting device sets control information for the light emission device based on the level information obtained by the level information acquiring device and the playback start information obtained by the playback start information acquiring device such that a single light emitter illuminates in an illumination mode that enables the playback state of the sound to be distinguished and the level of the sound reproduced to be notified.

BRIEF DESCRIPTION OF THE DRAWINGS

FIG. 2(*b*) is a functional block diagram for describing functions of an electronic musical instrument and a light emission control device.

FIG. 4(*b*) is a flow chart showing a level acquiring process executed in the tone playback process in 4(*a*).

FIG. 8(*b*) is a graph showing an example of changes in hit moment brightness of a single LED with time.

FIG. 8(*c*) is a graph showing an example of changes in output brightness of a single LED with time.

DETAILED DESCRIPTION

Figure 1:
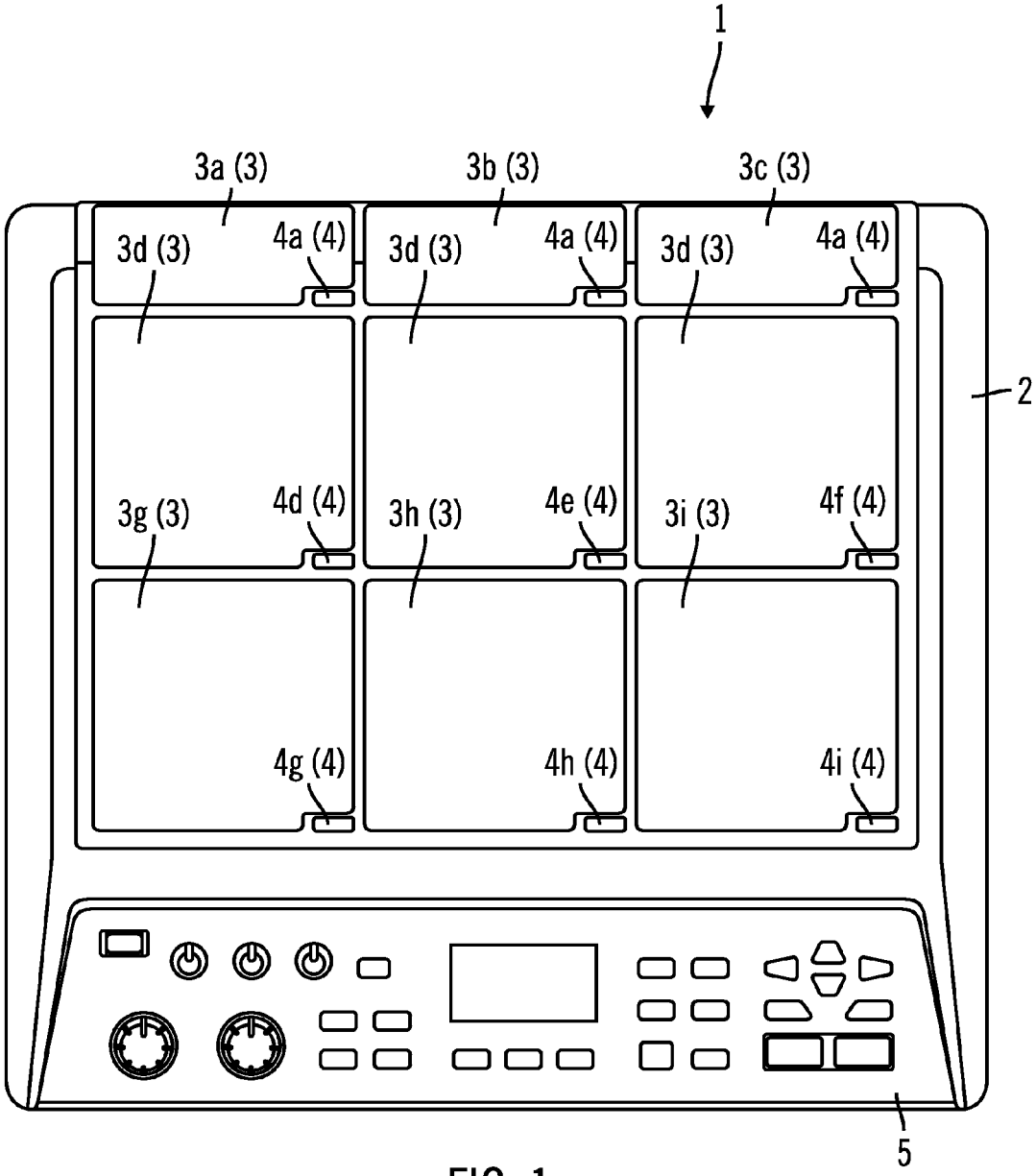
FIG. 1 is a front view of an electronic musical instrument.

Prior art level meters, such as described in the Japanese Patent Application JPH0655194, change the number of LEDs that illuminate according to the sound level. Therefore, if such a prior art level meter is used on a tone playback device, an electronic musical instrument or the like that reproduces tones based on tone data, when the level meter indicates zero, it is difficult for the user to judge as to whether the indication is caused by an event where tones are stopped, or whether it is caused by a silent portion included in tones being generated. Also, when the playback of a tone is started or stopped, if the level of the tone at that moment is zero (i.e., silent) or small, it is difficult for the user to distinguish the playback start timing or the stop timing of the tone, based on the level meter viewed. In this manner, the ability of prior art level meters to distinguish tones by visual observation is low.

Further, unlike the light emitters such as LEDs, a display that is capable of graphical display (for example, a LCD) can display information as to whether tones are in playback or stopped in a distinguishable manner, in addition to the level of the tones. However, a relatively large space is necessary for providing a display, which may cause other problems, such as, a limitation to device layout, a limitation to device miniaturization and the like.

Described embodiments provide a light emission control device that can improve tone distinguishability by visual observation.

In described embodiments, a light emission control device provides the following effect. Based on level information obtained by a level information acquiring device and playback start information obtained by a playback start information acquiring device, control information for a light emission device that causes a light emitter to illuminate is set by a setting device. In this instance, a single light emitter illuminates in an illumination mode that enables the sound playback state to be distinguished and the level of reproduced sound to be grasped. Therefore, by just looking at the illumination state of the single light emitter, the user can not only grasp the level of reproduced sound, but may also grasp the playback state of the sound (for example, as to whether or not the sound is being reproduced, the sound playback start timing, and the like). Accordingly, the tone distinguishability by visual observation can be improved.

In a further embodiment, the control information for the light emission device is set by a first setting device such that the single light emitter illuminates with brightness according to the level information, except a predetermined case. On the other hand, in the predetermined case, the control information for the light emission device is set by a second setting device such that the single light emitter illuminates with brightness in a predetermined level unrelated to the level information. The aforementioned predetermined case is a case where sound is being reproduced (during a period from the moment when playback start information is obtained until the moment when playback end information is obtained), and the level of the sound indicated by the level information is zero or less than a predetermined value. In other words, if silence is caused by non-reproduction of sound, the control information is set by the first setting device, such that the light emitter does not illuminate (in other words, the brightness of the light emitter is zero). On the other hand, if silence occurs during playback (or sound is small at less than a predetermined level), the control information is set by the second setting device, such that the light emitter illuminates with a predetermined level of brightness. Accordingly, even when reproduced sound cannot be heard (in other words, even in the silence state), the user can readily recognize as to whether or not sound is being reproduced by looking at the illumination state (brightness) of the light emitter.

In a further embodiment, in the predetermined case, the control information for the light emission device is set by the second setting device such that the single light emitter illuminates with brightness in a predetermined level unrelated to the level information. The aforementioned predetermined case refers to a case where sound is being reproduced, and a period in which the level of the sound indicated by the level information is zero or less than a predetermined value exceeds a predetermined time. In other words, while the sound is being generated, and until the period in which the level of the sound indicated by the level information is zero or less than the predetermined value reaches the predetermined time, the control information is set by the first setting device such that the light emitter may not illuminate or may illuminate with low brightness according to the level information. When the period exceeds the predetermined time, the control information is set by the second setting device such that the light emitter illuminates with brightness in a predetermined level. Accordingly, when silence (or small sound less than a predetermined level) occurs during playback, the brightness of the light emitter changes from zero or low brightness less than a predetermined level to the predetermined brightness level. This is effective in that the user can clearly recognize that the silence occurred during playback.

In a further embodiment, in the predetermined case described above, when playback start information is acquired by a playback start state acquiring device (in other words, when playback is started), and during a period from the acquisition until a second predetermined time elapses, the control information for the light emission device is set by a third setting device such that the single light emitter illuminates with brightness showing a predetermined change in brightness. In other words, during the period from the start of the playback until the second predetermined time elapses, the control information is set by the third setting device, such that the light emitter illuminates with brightness showing a predetermined change in brightness. Therefore, it is effective in that, by looking at the light emitter illuminating with brightness showing the predetermined change in brightness, the user can clearly grasp the playback start timing of the sound.

In a further embodiment, the setting device sets the control information based on the level information, the playback start information, and playback end information obtained by a playback end information acquiring device. Therefore, it is effective in that the user can also grasp the playback end timing as a sound playback state from the illumination state of the single light emitter.

In a further embodiment, in the predetermined case described above, when playback end information is obtained by a playback end state acquiring device (in other words, when playback is ended), the control information for the light emission device is set by a fourth setting device such that the single light emitter illuminates with brightness showing a predetermined change in brightness. This is effective in that, by looking at the light emitter illuminating with brightness showing the predetermined change in brightness, the user can readily grasp the playback end timing of the sound.

Preferred embodiments of the invention are described below with reference to the accompanying drawings. FIG. 1 is a front view of an electronic musical instrument 1. The electronic musical instrument 1 is provided with a light emission control device 100 (see FIG. 2(*b*)) mounted thereon. The electronic musical instrument 1 is configured such that each LED 4 (4*a*-4*i*) illuminates in an illumination mode by which not only the level (or the amplitude) of reproduced sound but also the playback state of tone (sound) can be discriminated. This enhances the ability to distinguish tones by visual observation.

The electronic musical instrument 1 has a body 2, and nine pads 3 (3*a*-3*i*), nine LEDs 4 (4*a*-4*i*), and an operation panel 5 on a front face of the body 2. The pads 3 (3*a*-3*i*) are striking surfaces to be hit by the user. Waveform data is assigned to each of the pads 3*a*-3*i*. When any of the pads 3 are struck in a playback mode, the electronic musical instrument 1 can reproduce or stop tones based on the waveform data assigned to those of the pads being struck. It is noted that the striking of the pad 3 will be described below, assuming that the striking occurs when the mode of the electronic musical instrument 1 is set in a playback mode.

Each of the LEDs 4 (4*a*-4*i*) is a light emitter associated with each of the pads 3 (3*a*-3*i*). In the present embodiment, the LEDs 4 (4*a*-4*i*) are single color LEDs. When the pad 3 (3*a*-3*i*) is struck and the resulting tone is reproduced, the LED 4 (4*a*-4*i*) corresponding to the tone being reproduced (in other words, corresponding to the pad 3 being struck) illuminates with brightness in a level according to the level and the playback state of the reproduced sound. As shown in FIG. 1, the LEDs 4*a*-4*i* are provided at right lower sections of the corresponding pads 3*a*-3*i*, respectively, so that their corresponding relations with the pads 3*a*-3*i* can be readily recognized. The operation panel 5 is a panel provided with a display device, operation elements and the like as user interfaces.

Figure 2A:
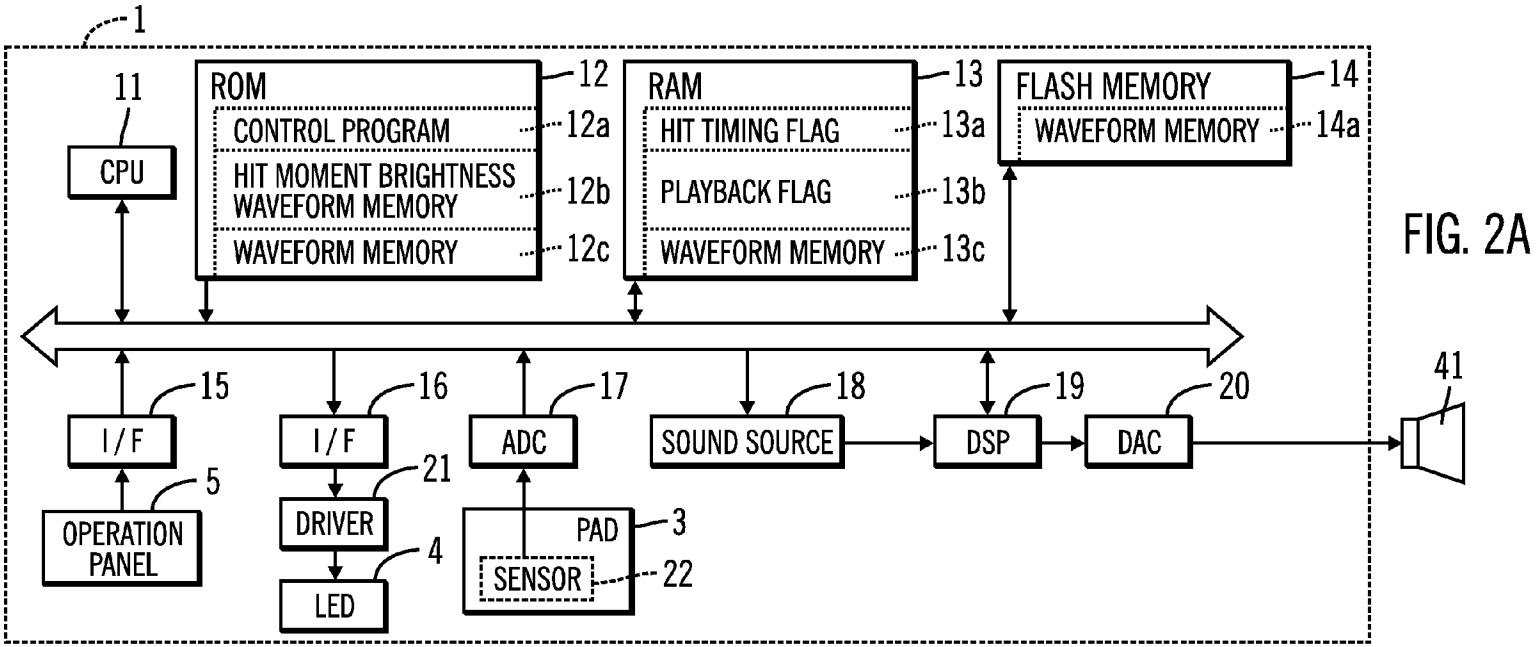
FIG. 2(*a*) is a block diagram showing an electrical structure of an electronic musical instrument.
Figure 2B:
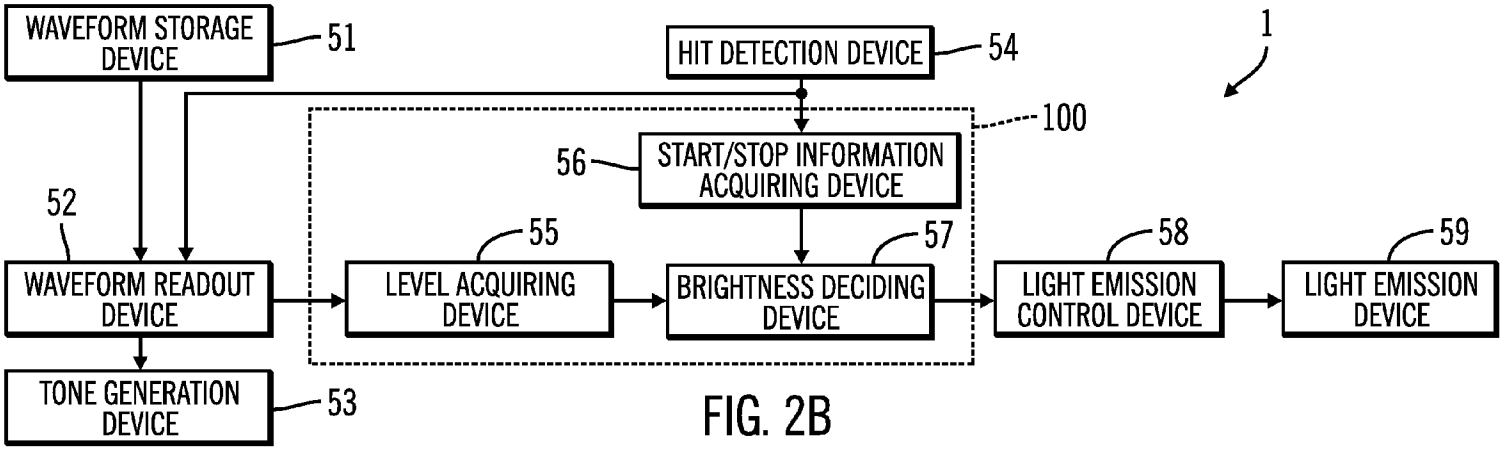

FIG. 2(*a*) is a block diagram showing an electrical structure of the electronic musical instrument 1. The electronic musical instrument 1 is provided with a CPU 11, a Read Only Memory (ROM) 12, a Random Access Memory (RAM) 13, a flash memory 14, two interfaces (I/Fs) 15 and 16, an analog-to-digital converter (ADC) 17, a sound source 18, a digital signal processor (DSP) 19, a digital-to-analog converter (DAC) 20, a driver 21, and a sensor 22. A light emission control device 100 is formed from the CPU 11, the ROM 12, the RAM 13 and the DSP 19.

The components 11-19 are mutually connected through a bus line 23. The sound source 18 is also connected to the DSP 19. The DSP 19 is connected to the DAC 20. The I/F 15 is connected to a display device, operation elements and the like (not shown) provided on the aforementioned operation panel 5. The I/F 16 is connected to the LEDs 4*a*-4*i* via the driver 21. The ADC 17 is connected to a sensor 22 provided for each of the pads 3 (3*a*-3*i*).

The CPU 11 is a central control unit that controls each of the components of the electronic musical instrument 1 according to fixed values and a control program stored in the ROM 12 and data stored in the RAM 13. The CPU 11 includes a built-in timer (not shown) that counts clock signals, thereby measuring the time.

Upon detecting a trigger signal sent from the sensor 22, indicating that the pad 3 has been struck, in a state where no tone is being reproduced, the CPU 11 outputs an instruction to reproduce a tone corresponding to the pad 3 being struck to the sound source 18 to have the sound source 18 reproduce the tone. On the other hand, upon detecting a trigger signal from the sensor 22 while a tone is reproduced, the CPU 11 outputs an instruction to stop the tone corresponding to the pad 3 being struck to have the sound source 18 stop the playback of the tone. Also, the CPU 11 controls illumination modes of the LEDs 4 (4*a*-4*i*). The CPU 11 controls the brightness of the LED 4 so that not only the level of reproduced sound but also the playback state of tone (sound) can be discriminated.

The ROM 12 is a non-rewritable nonvolatile memory. The ROM 12 stores a control program 12*a* to be executed by the CPU 11 and the DSP 19, and fixed value data (not shown) to be referred to by the CPU 11 when the control program 12*a* is executed, and the like. It is noted that each of the processes shown in the flow charts in FIGS. 3 through 7 may be executed by the control program 12*a*. Also, the ROM 12 has a hit moment brightness waveform memory 12*b* and a waveform memory 12*c*.

The hit moment brightness waveform memory 12*b* is a region for storing a specific brightness change pattern (a brightness change pattern that changes with time) to be referred to when the pad 3 is struck. It is noted that the shape of the brightness change pattern stored in advance in the hit moment brightness waveform memory 12*b* is not particularly limited, but the pattern may have, for example, a sharp pointed shape in which its peak shows a relatively high level of brightness, and its brightness reaches the peak in a short time. It is noted that a period in which the brightness change pattern is referred to (in other words, a period spanning from the starting edge to the finishing edge of the brightness change pattern in which the brightness according to the brightness change pattern is read out) is called a "reference period" or a "readout period." When the pad 3 is struck, the electronic musical instrument 1 is configured to control the brightness of the LED 4 based on the level of the reproduced tone and the brightness change pattern stored in the hit moment brightness waveform memory 12*b*. By the configuration described above, the user who sees the LED 4 can readily recognize the start or the stop of tone playback.

The waveform memory 12*b* stores digital waveform data of a predetermined number of tones as pre-set data. The waveform data stored in the waveform memory 12*b* are suitably assigned to the pads 3 (3*a*-3*i*) as desired by the user.

The RAM 13 is a rewritable volatile memory. The RAM 13 has a temporary storage area for temporarily storing various kinds of data for the CPU 11 to execute the control program 12*a*. The temporary area of the RAM 13 is provided with a hit timing flag 13*a*, a playback flag 13*b* and a waveform memory 13*c*.

The hit timing flag 13*a* is a flag indicating that the pad 3 (3*a*-3*i*) is struck, and is provided for each of the pads 3*a*-3*i*. In other words, nine hit timing flags 13*a* are provided for the pads 3*a*-3*i*, respectively. When the pad 3 is struck, the hit timing flag 13*a* corresponding to the pad 3 being struck is set to ON, and is thereafter turned to OFF when a predetermined time has elapsed. In the present embodiment, the "predetermined time" corresponds to the reference period described above (i.e., the period spanning from the starting edge to the finishing edge of the brightness change pattern in which the brightness according to the brightness change pattern is read out). In other words, the hit timing flag 13*a* is ON while the brightness change pattern is referred to, and OFF in other periods (in other words, during periods in which the brightness change pattern is not referred to). It is noted that the entire hit timing flags 13*a* are initialized (set to OFF) as the electronic musical instrument 1 is powered on.

The playback flag 13*b* is a flag indicating as to whether or not a tone is being reproduced, and is provided for each of the pads 3*a*-3*i*. In other words, nine playback flags 13*b* are provided for the pads 3*a*-3*i*, respectively. When the pad 3 is struck thereby starting the playback of a tone, the playback flag 13*b* corresponding to the tone being reproduced (in other words, the playback flag 13*b* corresponding to the pad 3 being struck) is set to ON. Thereafter, when the pad 3 is struck thereby stopping the playback of the tone, the playback flag 13*b* corresponding to the tone whose playback is stopped (in other words, the playback flag 13*b* corresponding to the pad 3 being struck) is set to OFF. It is noted that the entire playback flags 13*b* are initialized (set to OFF) as the electronic musical instrument 1 is powered on.

The waveform memory 13*c* temporarily stores digital waveform data of a tone inputted through an unshown input terminal and sampled. The waveform memory 13*c* is capable of storing one set or multiple sets of waveform data. The waveform data stored in the waveform memory 13*c* are suitably assigned to the pads 3 (3*a*-3*i*), respectively, as desired by the user. It is noted that the waveform memory 13*c* is cleared as the electronic musical instrument 1 is powered on.

The flash memory 14 is a rewritable non-volatile memory, and has a waveform memory 14*a* for storing digital waveform data of tones. The waveform memory 14*a* is capable of storing one set or multiple sets of waveform data. It is noted that the waveform data stored in the waveform memory 14*a* may be prepared in advance by the manufacturer. Also, the waveform data stored in the waveform memory 14*a* may be copies of waveform data sampled and stored in the waveform memory 13*c*, or may be waveform data sampled by a device other than the electronic musical instrument 1. The waveform data stored in the waveform memory 14*a* are suitably assigned to the pads 3 (3*a*-3*i*), respectively, as desired by the user.

Upon receiving an instruction to reproduce a tone from the CPU 11, the sound source 18 reads out waveform data of the tone instructed (in other words, waveform data assigned to the pad 3 being struck), and supplies the same to the DSP 19, thereby starting the playback of the tone. Waveform data is read out from the waveform memory 12*c*, the waveform memory 13*c* or the waveform memory 14*a*. On the other hand, upon receiving an instruction to stop a tone from the CPU 11, the sound source 18 stops reading waveform data of the tone instructed (in other words, waveform data assigned to the pad 3 being struck). The sound source 18 may repeatedly read waveform data of the tone being reproduced until it receives a stop instruction from the CPU 11.

The DSP 19 is an operation device for processing digital waveform data supplied from the sound source 18. The DSP 19 supplies processed digital waveform data to the DAC 20. The DAC 20 converts digital waveform data inputted from the DSP 19 into analog waveform data, and outputs the same to a speaker system 41. By this, reproduced sound (reproduced tone) is outputted from the speaker system 41.

The sensor 22 is formed from unshown nine hit sensors (for example, piezoelectric elements). The nine hit sensors are provided at the back surfaces of the respective pads 3*a*-3*i* described above. The sensor 22 is connected to the ADC 17. When the pad 3 is struck, vibration caused by the impact is detected by the sensor 22 provided at the back surface of the pad 3 being struck, and is outputted as an analog electrical signal (a trigger signal) to the ADC 17. The analog trigger signal inputted in the ADC 17 is converted to a digital signal, and the digital trigger signal is supplied to the CPU 11.

The driver 21 is an LED driver that drives the LED 4 (4*a*-4*i*) to illuminate. The driver 21 is connected to each of the LEDs 4*a*-4*i*, and is also connected to the I/F 16. The driver 21 drives the LED 4 (4*a*-4*i*) according to control information indicative of an illumination mode, which is inputted from the CPU 11 through the I/F 16. The driver 21 controls the brightness of each of the LEDs 4 (4*a*-4*i*) by PWM (Pulse Width Modulation) control. Therefore, when the control information supplied from the CPU 11 is information designating the brightness of the LED 4, a power pulse with a duty ratio according to the designated brightness is supplied to the LED 4 to be controlled. By this, each of the LEDs 4 illuminates with brightness in a level according to the duty ratio of the supplied power pulse, in other words, with brightness in a level specified by the CPU 11.

FIG. 2(*b*) is a functional block diagram for describing the functions of the electronic musical instrument 1 and the light emitting control device 100 mounted on the electronic musical instrument 1. As shown in FIG. 2(*b*), the light emission control device 100 includes a level acquiring device 55, a start/stop information acquiring device 56, and a brightness deciding device 57.

The hit detection device 54 is equipped with a function to detect a striking on the pad 3 (each of the pads 3*a*-3*i*), and is realized by the sensor 22. The hit detection device 54, upon detecting a striking, supplies information indicating that a striking is detected (for example, a trigger signal) to a waveform readout device 52 and the start/stop information acquiring device 56.

The waveform readout device 52 may be realized by the CPU 11 and the sound source 18. Upon receiving information from the hit detection device 54 indicating that a striking is detected, the waveform readout device 52 reads out waveform data from the waveform storage device 51, and supplies the waveform data readout to a tone generation device 53 and the level acquiring device 55. The waveform storage device 51 is equipped with a function to store waveform data, and may be realized by the waveform memories 12*c*, 13*c* and 14*a*.

The tone generation device 53 is realized by the DSP 19 and the DAC 20. The tone generation device 53 processes digital waveform data supplied from the waveform readout device 52, converts the same to analog waveform data, and has the reproduced sound output from the speaker system 41.

The level acquiring device 55 may be realized by the CPU 11 and the DSP 19, and forms a part of the light emission control device 100. The level acquiring device 55 obtains the level of a tone from the waveform data supplied from the waveform readout device 52, and supplies the obtained level to the brightness deciding device 57.

The start/stop information acquiring device 56 may be realized by the CPU 11 and forms a part of the light emission control device 100. Upon receiving information indicating that a striking is detected from the hit detection device 54, the start/stop information acquiring device 56 obtains start/stop information indicating as to whether the striking is a striking for starting the playback of a tone or a striking for stopping the playback of a tone. Further, the start/stop information acquiring device 56 supplies the obtained start/stop information to the brightness deciding device 57.

The brightness deciding device 57 may be realized by the CPU 11 or the like, and forms a part of the light emission control device 100. The brightness deciding device 57 decides the brightness of illumination of a light emission device 59 (LED 4) (hereafter, this brightness is called the "output brightness"), based on the level of tone supplied from the level acquiring device 55 and the start/stop information supplied from the start/stop information acquiring device 56. Further, the brightness deciding device 57 supplies control information indicative of the decided output brightness to the light emission control device 58.

The light emission control device 58 is equipped with a function to control the illumination mode of the light emission device 59 according to the control information, and may be realized by the driver 21. According to the control information supplied from the brightness deciding device 57, the light emission control device 58 supplies a power pulse with a duty ratio according to the specified brightness to the light emission device 59. The light emission device 59 is equipped with a light emission function, and may be realized by the LED 4 (4*a*-4*i*). The light emission device 59 is driven by the power pulse supplied from the light emission control device 58 and illuminates accordingly.

Figure 3:
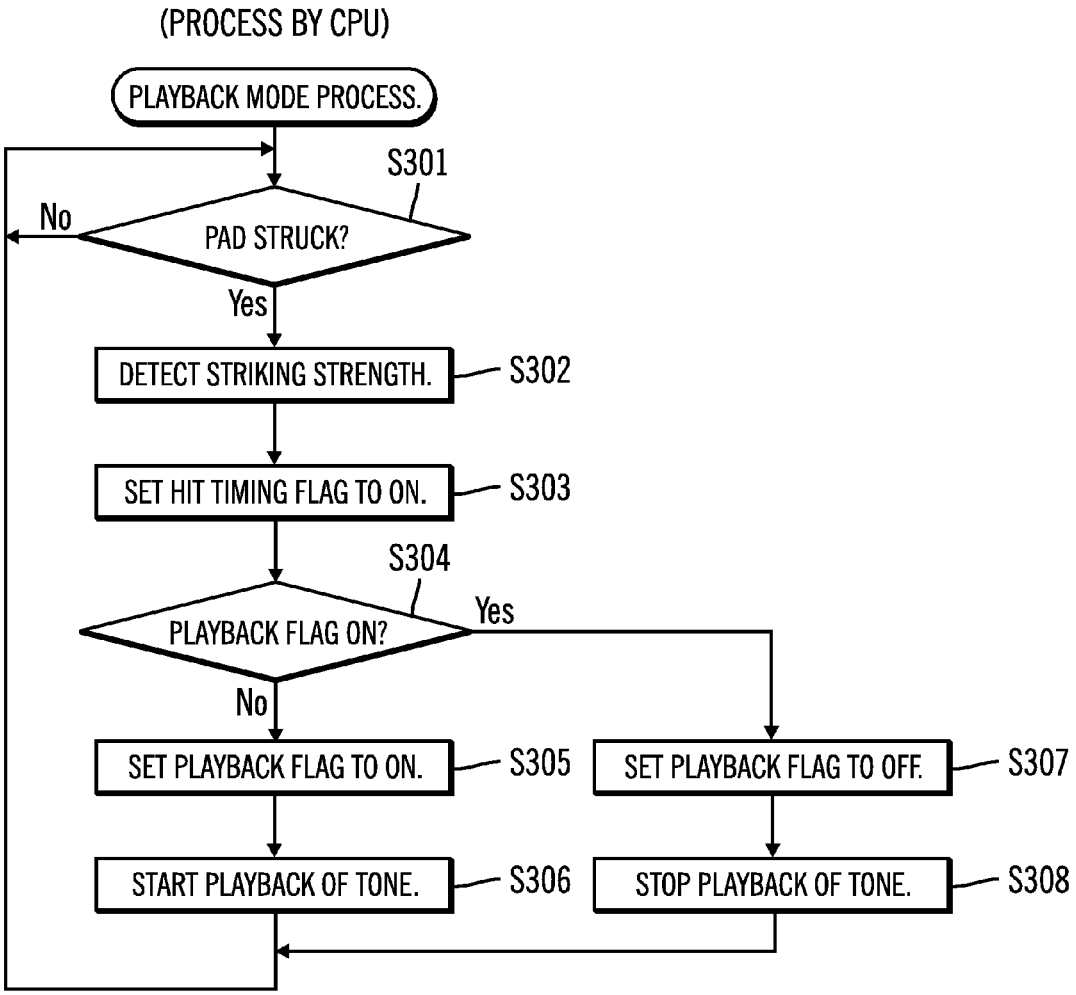
FIG. 3 is a flow chart showing a playback mode process executed by a central processing unit (CPU).

Next, referring to FIGS. 3-7, the processes executed by the CPU 11 or the DSP 19 of the light emission control device 100 mounted on the electronic musical instrument 1 having the above-described configuration will be described. First, FIG. 3 is a flow chart of a playback mode process executed by the CPU 11. The playback mode process is executed when the electronic musical instrument 1 is set to a playback mode.

First, the CPU 11 judges as to whether a pad 3 (3*a*-3*i*) is struck based on whether or not it receives a trigger signal from the sensor 22 (S301). If the pad 3 has not been struck (S301: No), the CPU 11 returns the process to S301.

When the CPU 11 receives a trigger signal from the sensor 22, thereby judging that the pad 3 has been struck (S301: Yes), the CPU 11 detects the strength of the strike (the strength of the trigger signal) (S302). The CPU 11 outputs information indicative of the striking strength detected in S302 to the DSP 19. The DSP 19 processes waveform data to have a playback level according to the information indicative of the striking strength. More specifically, the DSP 19 processes such that, the greater the striking strength (in other words, the stronger the pad is struck), the greater the playback level becomes. In other words, the stronger the pad 3 is struck, the greater playback level the tone is reproduced.

Next, the CPU 11 sets a hit timing flag 13*a* corresponding to the pad 3 being struck to ON (S303). Further, the CPU 11 judges as to whether or not a playback flag 13*b* corresponding to the pad 3 being struck is ON (S304). If the playback flag 13*b* is OFF (S304: No), a tone corresponding to the pad 3 being struck is not reproduced, and the striking of the pad 3 has been performed for starting playback of the tone. In this case, the CPU 11 sets a target playback flag 13*b* to ON (S305). Next, the CPU 22 instructs the sound source 18 to start reading waveform data corresponding to the pad 3 being struck, thereby starting playback of a tone (S306), and returns the process to S301.

When it is judged in S304 that the playback flag 13*b* is ON (S304: Yes), a tone corresponding to the pad 3 struck is being reproduced, and the striking on the pad 3 has been performed for stopping the playback of the tone. In this case, the CPU 11 sets a target playback flag 13*b* to OFF (S307). Next, the CPU 11 instructs the sound source 18 to stop reading waveform data corresponding to the pad 3 being struck, thereby stopping the playback of the tone (S308), and returns the process to S301.

Figure 4A:
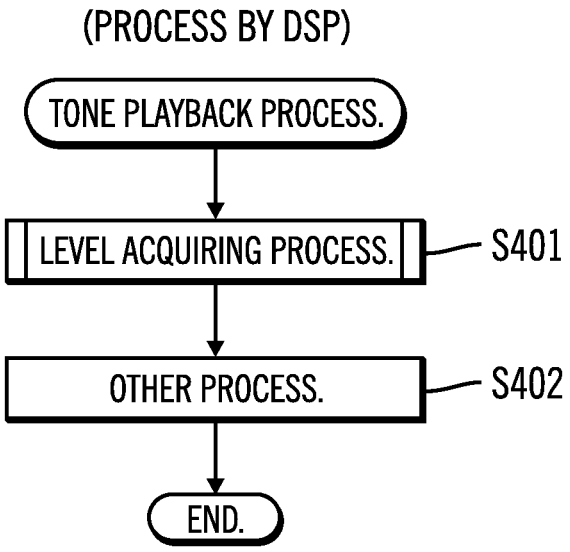
FIG. 4(*a*) is a flow chart showing a tone playback process executed by Digital Signal Processor (DSP).
Figure 4B:
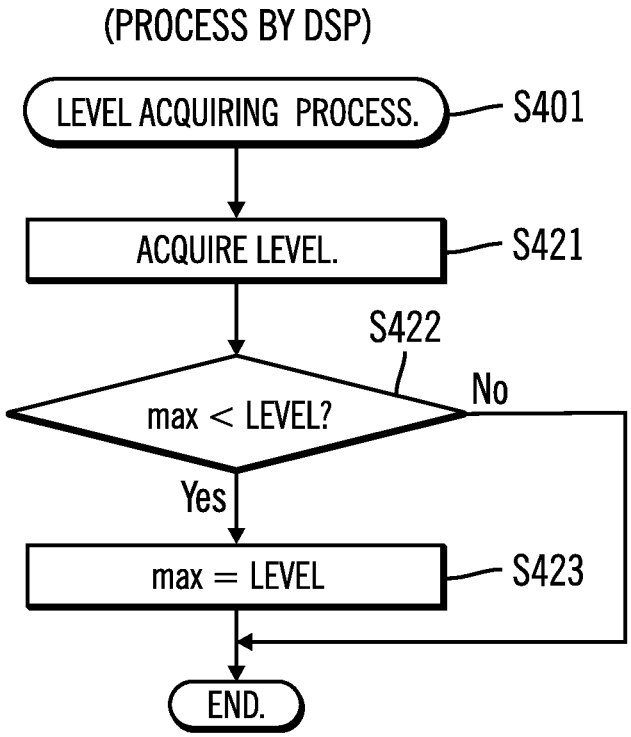

FIG. 4(*a*) is a flow chart showing a tone playback process executed by the DSP 19. The tone playback process is repeatedly executed at a predetermined sampling period (for example, 44.1 kHz) during playback of tones. First, the DSP 19 executes a level acquiring process to acquire the level of a tone from waveform data supplied from the sound source 18 (S401), executes other processes (S402), and ends the tone playback process. It is noted that the other processes (S402) include, for example, a process to set a playback level according to information indicative of the striking strength on the pad 3, a process to add an effect that has been set, and the like.

FIG. 4(*b*) is a flow chart showing a level acquiring process (S401) executed in the tone playback process of FIG. 4(*a*). First, the DSP 19 acquires the level of waveform data (S421). Then, the DSP 19 judges if a value "max" is greater than the level acquired in S421 (S422). The value "max" is a value indicative of the maximum level of waveform data during a period from the starting point of the waveform data or from the moment a light emission control process (see FIG. 5), which is a timer interrupt process, was executed last time until the present moment, and is stored in a predetermined region of the RAM 13. The value "max" will be used as the "level of a tone" when the brightness is set in a level meter brightness conversion process to be described below (see FIG. 6). The value "max" is stored for each of the pads 3.

When the level acquired in S421 is greater than the value "max" (S422: Yes), the maximum level of the waveform data during the period from the starting point of the waveform data or from the moment the light emission control process was executed last time until the present moment is the level acquired in S421. In this case, the DSP 19 updates the value "max" to the level acquired (S423), and ends the process. On the other hand, when the acquired level is less than the value "max" (S422: No), the maximum level of the waveform data during the aforementioned period is the value "max." In this case, the DSP 19 ends the level acquiring process.

Figure 5:
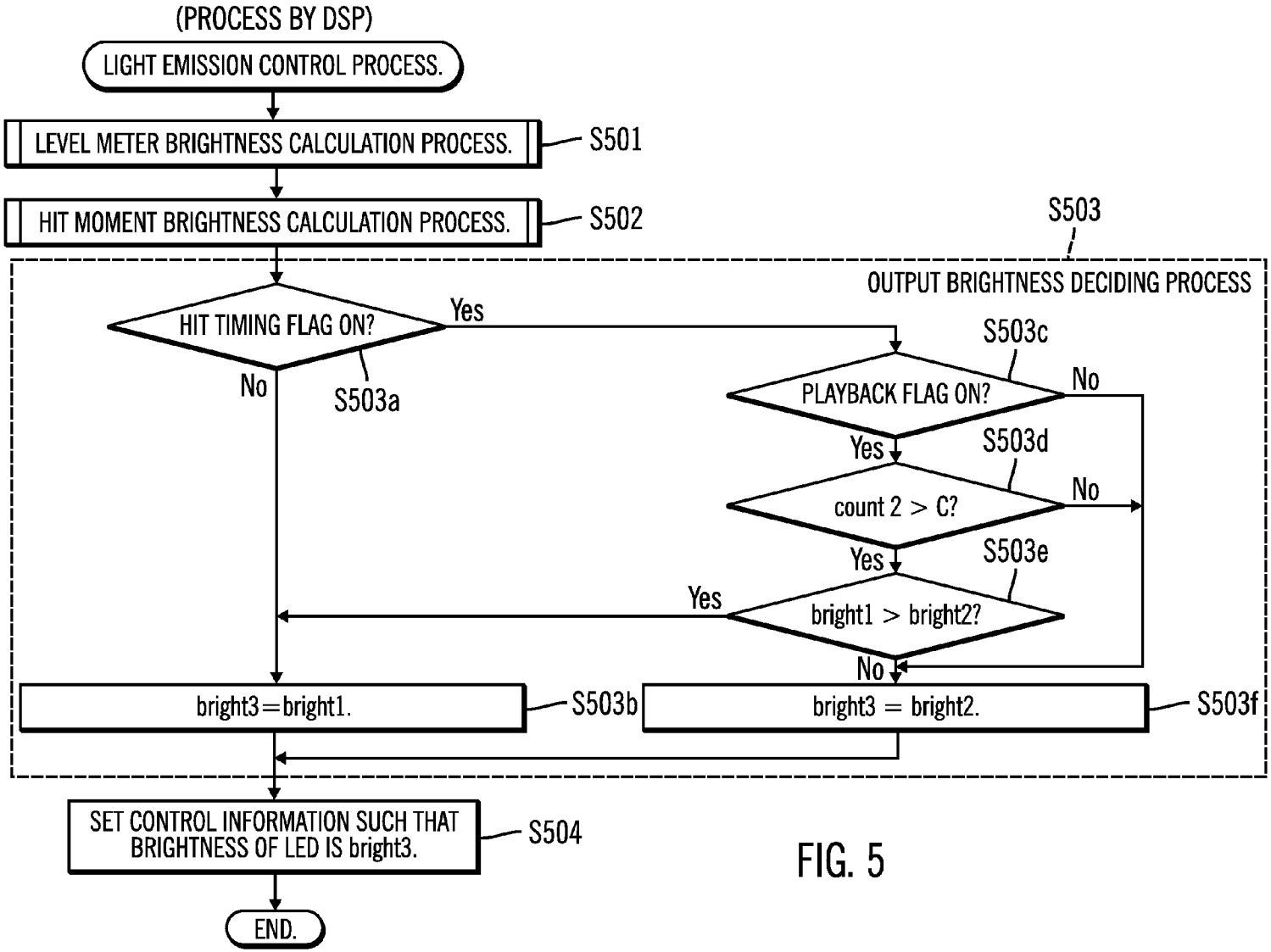
FIG. 5 is a flow chart showing a light emission control process executed by the CPU.

FIG. 5 is a flow chart showing the light emission control process executed by the CPU 11. The light emission control process is a timer interrupt process executed every 50 msec. As shown in FIG. 5, the light emission control process is composed of processes S501-S504. The processes S501-504 are executed for each of the LEDs 4*a*-4*i*.

First, the CPU 11 executes a level meter brightness calculation process for each of the LEDs 4 (4*a*-4*i*) to calculate the brightness according to the level of the tone (the value "max") (S501). Details of the level meter brightness calculation process (S501) will be described below with reference to FIG. 6. It is noted that, in the following description, the brightness to be calculated by the level meter brightness calculation process is called the "level meter brightness."

Next, the CPU 11 executes a hit moment brightness calculation process to calculate the brightness based on the striking on the corresponding pad 3 (S502). Details of the hit moment brightness calculation process (S502) will be described below with reference to FIG. 7. It is noted that, in the following description, the brightness to be calculated by the hit moment brightness calculation process, in other words, the brightness based on the striking on the pad 3, will be called the "hit moment brightness."

Next, the CPU 11 executes an output brightness deciding process (S503) for each of the LEDs 4*a*-4*i*. The output brightness deciding process (S503) is a process to decide the brightness of illumination of each of the LEDs 4 (in other words, the output brightness) based on the level meter brightness calculated in the level meter brightness calculation process (S501) and the hit moment brightness calculated in the hit moment brightness calculation process (S502).

The output brightness deciding process (S503) is composed of processes S503*a*-S503*f*. More specifically, in the output brightness deciding process (S503), first, the CPU 11 judges as to whether the hit timing flag 13*a* is ON (S503*a*). If the hit timing flag 13*a* is OFF (S503*a*: No), the CPU 11 sets a value "bright1" to a value "bright3" (S503*b*).

The "bright1" refers to the level meter brightness calculated in the level meter brightness calculation process (S501). On the other hand, the "bright3" refers to the output brightness, in other words, the value indicative of the brightness of the LED 4 to be illuminated, and is stored in a predetermined region of the RAM 13. It is noted that the value "bright1" and the value "bright3" are stored for each of the pads 3. As described above, in accordance with the present embodiment, when the hit timing flag 13*a* is OFF, the brightness change pattern stored in the hit moment brightness waveform memory 12*b* is not referred to. Therefore, when the hit timing flag 13*a* is OFF (in other words, outside of the reference period), the calculated level meter brightness (bright1) is decided as being the output brightness (bright3).

In S503*a*, when the hit timing flag 13*a* is ON (S503*a*: Yes), the CPU 11 judges as to whether the playback flag 13*b* is ON (S503*c*). When the playback flag 13*b* is ON in S503*c* (S503*c*: Yes), this means that the hit timing flag 13*a* is set to ON because the pad 3 has been struck for starting the playback of a tone. In this case, the CPU 11 judges whether a value "count2" is greater than a predetermined value C (S503*d*).

The value "count2" is a count value for measuring the time of the reference period of (the readout period of) the brightness change pattern stored in the hit moment brightness waveform memory 12*b*, and is stored in a predetermined region of the RAM 13. The value "count2" is stored for each of the pads 3. Although details will be discussed below, the value "count2" is updated in the hit moment brightness calculation process (S502). In other words, the value "count2" is updated every 50 msec that is the execution interval of the light emission control process.

The value "C" is a count value indicative of the end timing of a period in which the hit moment brightness is given priority in the time measurement executed through updating the value "count2" (hereafter, this period is called the "preferential period"). In the present embodiment, the preferential period is 300 millisecond (msec). Therefore, in accordance with the present embodiment, C=6. It is noted that the preferential period is a period starting from the striking on the pad 3 and equals to or shorter than the reference period (readout period) of the brightness change pattern stored in the hit moment brightness waveform memory 12*b*. Therefore, in accordance with the present embodiment, in S503*d*, the CPU 11 judges as to whether the value count2 is greater than 6.

When the value "count2" is greater than C (6 in the present embodiment), in other words, is outside the preferential period (S503*d*: Yes), the CPU 11 judges as to whether the value "bright1" is greater than a value "bright2" (S503*e*).

The value "bright2" is a value indicative of the hit moment brightness calculated in the hit moment brightness calculation process (S502), and is stored in a predetermined region of the RAM 13. The value "bright2" is stored for each of the pads 3. In other words, in S503*e*, the CPU 11 judges as to whether or not the calculated level meter brightness (bright1) is greater than the calculated hit moment brightness (bright2).

When it is judged in S503*e* that the value "bright1" is greater than the value "bright2" (S503*e*: Yes), the CPU 11 sets the value "bright1" to the value "bright3" (S503*b*). On the other hand, when the value "bright1" is less than the value "bright2" (S503*e*: No), the CPU 11 sets the value "bright2" to the value "bright3" (S503*f*). Therefore, when the pad 3 is struck for starting the playback (in other words, during the playback of a tone), and when the hit timing flag 13*a* is ON (in other words, during the reference period), and it is outside the preferential period, one with a higher brightness level among the calculated level meter brightness (bright1) and the hit moment brightness (bright2) is decided as being the output brightness (bright3).

When the value "count2" is less than C in S503*d*, in other words, it is during the preferential period (S503*d*: No), the CPU 11 sets the value "bright2" to the value "bright3" (S503*f*). Therefore, when the pad 3 is struck for starting the playback of a tone, and it is within the reference period and within the preferential period, the hit moment brightness (bright2) is decided as being the output brightness (bright3), irrespective of the calculated level meter brightness (bright1).

On the other hand, when it is judged in S503*c* that the playback flag 13*b* is OFF (S503*c*: No), this means that the hit timing flag 13*a* is set to ON as the pad 3 has been struck for stopping the tone being reproduced. In this case, the level of the tone is zero, and the level meter brightness calculated (bright1) is also zero. Therefore, in this case, the CPU 11 sets the value "bright2" to the value "bright3" (S503*f*). In other words, when the pad 3 is struck for stopping the tone being reproduced, the hit moment brightness (bright2) is decided as being the output brightness (bright3) until the reference period of the brightness change pattern ends, and the hit timing flag 13*a* is set to OFF.

When the CPU 11 executes the process in S503*b* or S503*f*, the output brightness deciding process (S503) ends. After the output brightness deciding process (S503), the CPU 11 sets control information (S504) such that the brightness of the LED 4 (4*a*-4*i*) to be processed becomes equal to the output brightness (bright3) decided in the output brightness deciding process (S503), and ends the process.

The CPU 11 outputs the control information set for each of the LEDs 4 corresponding to tones being generated to the driver 21 through the I/F 16. The driver 21 controls the brightness of the LED 4 to be controlled through PWM control according to the inputted control information. By this, each of the LEDs 4*a*-4*i* illuminates or lights out according to the decided output brightness (bright3).

Figure 6:
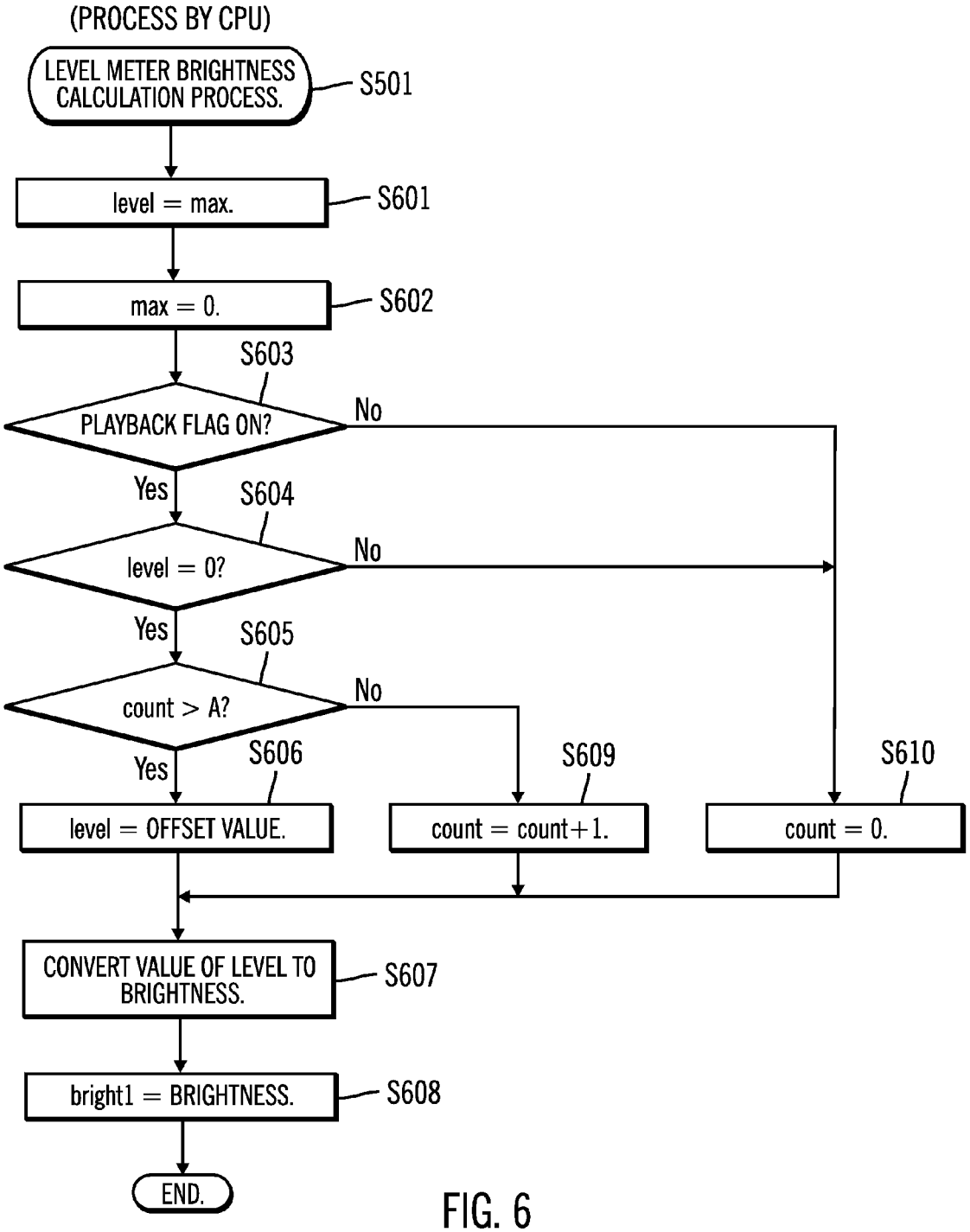
FIG. 6 is a flow chart showing a level meter brightness calculation process executed in the light emission control process of FIG. 5.

FIG. 6 is a flow chart showing a level meter brightness calculation process (S501) executed in the light emission control process in FIG. 5. The CPU 11 assigns the value "max" into a variable "level" (S601) and assigns the value "zero" into a variable "max" (S602). The "level" is a value indicative of the level of a current tone, and is stored in a predetermined region of the RAM 13. It is noted that the value "level" is stored for each of the pads 3.

Next, the CPU 11 judges as to whether the playback flag 13*b* is ON (S603). When the playback flag 13*b* is ON, in other words, when a tone is being reproduced (S603: Yes), the CPU 11 judges as to whether the value "level" is zero (S604).

When it is judged in S604 that the value "level" is zero, in other words, when the tone is being reproduced, but its level is zero (S604: Yes), the CPU 11 judges as to whether a value "count" is greater than a predetermined value A (S605).

The value "count" is a count value for measuring the time of a period in which the value "level" is not changed, when the tone is being reproduced but its value "level" is zero (hereafter, this period is called the "offset standby period"). The value "count" is stored in a predetermined region of the RAM 13 for each of the pads 3. The value "count" is updated in the light emission control process (more specifically, the level meter brightness calculation process) executed every 50 msec.

The value "A" is a count value indicative of the end timing of the offset standby period in the time measurement executed through updating the value "count." In accordance with the present embodiment, when a tone is being reproduced, and the period in which the level of the tone is zero exceeds 150 msec, the value "level" is set to a predetermined offset value. More specifically, in the present embodiment, the "offset standby period" is 150 msec. Therefore, in the present embodiment, A=3. Accordingly, in accordance with the present embodiment, the CPU 11 judges in S605 as to whether the value "count" is greater than 3.

When the value "count" is less than or equal to A (3 in the present embodiment), in other words, when it is during the offset standby period (S605: No), the CPU 11 updates the value "count" by adding 1 thereto (S609). Next, the CPU 11 converts the value "level" to a brightness level (LED brightness level) according to a predetermined relational expression (S607), and sets the brightness level obtained in S607 as the value of the level meter brightness (bright1) (S608). Therefore, when a tone is being reproduced, and the level of the tone is zero (in other words, in the case of a silence state during playback), and when the period in which the level of the tone is zero does not reach the offset standby period, the value "level" is zero, such that the level meter brightness (bright1) is set to zero.

It is noted that the relational expression to be used in S607 to convert the value "level" to a brightness level may be, for example, a relational expression that changes the brightness greater as the value "level" becomes greater during a period from the value "level" being zero to a predetermined value, where the brightness is zero when the value "level" is zero, and the brightness is at a maximum value when the value "level" is greater than the predetermined value. For example, a relational expression that linearly increases the brightness as the value "level" becomes greater may be used.

On the other hand, when it is judged in S605 that the value "count" exceeds A (S605: Yes), the CPU 11 sets the value "level" to a predetermined offset value (S606), and proceeds the process to S607. Therefore, when the period of a silence state during playback exceeds the offset standby period, the level meter brightness (bright1) is set to a brightness level corresponding to the offset value. In other words, in accordance with the level meter brightness calculation process (S501) of the present embodiment, when a silence state is included in playback tones, the corresponding one of the LEDs 4 is kept turned off until the period of the silence state during playback reaches 150 msec. However, when the period of the silence state during playback exceeds 150 msec, the corresponding one of the LEDs 4 illuminates with a predetermined brightness level.

When it is judged in S604 that the value "level" is not zero (S604: No), the CPU 11 sets the value "count" to zero (S605), and proceeds the process to S607. Therefore, when a tone is being reproduced, and the level of the tone is not zero, the value "level" is set to the level of the tone, and the level meter brightness (bright1) is set to a brightness level according to the level of the tone.

When it is judged in S603 that the playback flag 13*b* is OFF, in other words, a tone is not reproduced (S603: No), the CPU 11 sets the value "count" to zero (S605), and proceeds the process to S607. When a tone is not reproduced, the value "level" is zero, and the level meter brightness (bright1) is set to zero.

Figure 7:
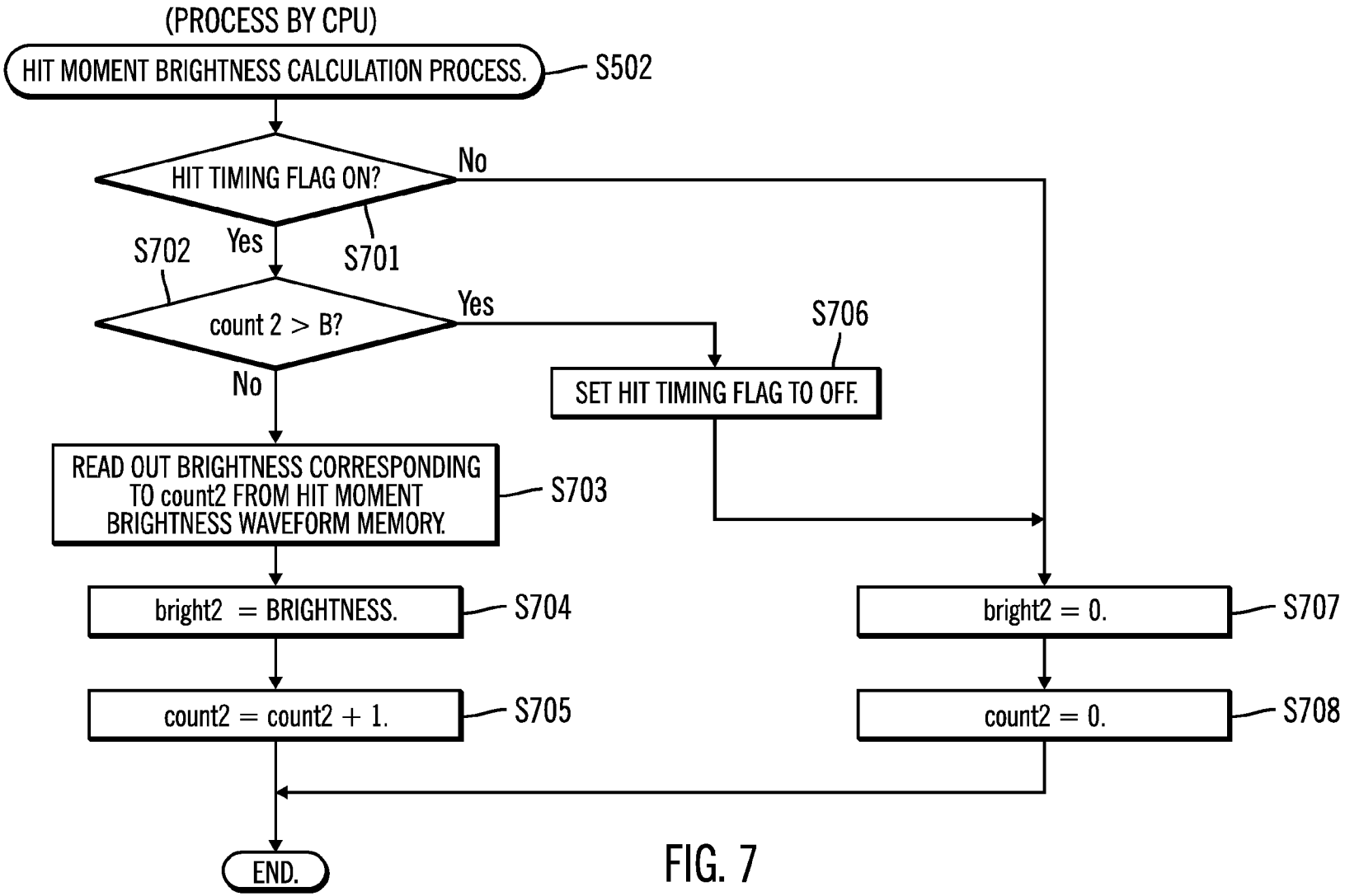
FIG. 7 is a flow chart showing a hit moment brightness calculation process executed in the light emission control process of FIG. 5.

FIG. 7 is a flow chart showing the above-described hit moment brightness calculation process (S502). First, the CPU 11 judges as to whether the hit timing flag 13*a* is ON (S701). When the hit timing flag 13*a* is ON (S701: Yes), the CPU 11 judges as to whether the value "count2" is greater than a predetermined value B (S702). It is noted that the predetermined value "B" is a count value indicative of the end timing of the reference period (readout period) of a brightness change pattern stored in the hit timing brightness waveform memory 12*b*, in the time measurement executed through updating the value "count2." In accordance with the present embodiment, the reference period of a brightness change pattern is 500 msec. Therefore, in the present embodiment, B=10. Accordingly, in accordance with the present embodiment, the CPU 11 judges in S702 as to whether the value "count2" is greater than 10.

When the value "count2" is less than or equal to the value "B" (10 in the present embodiment), in other words, it is during the reference period of a brightness change pattern (S702: No), the CPU 11 reads out a brightness level corresponding to the value "count2" from the hit moment brightness waveform memory 12*b* (S703). Next, the CPU 11 sets the brightness level readout in S703 to the value of the hit moment brightness (bright2) (S704). Therefore, during the reference period of a brightness change pattern, the brightness level in the brightness change pattern according to the elapsed time since the pad 3 was struck is set as the value of the hit moment brightness (bright2). Next, the value "count2" is updated by adding 1 thereto (S705), and the present process ends.

On the other hand, when it is judged in S702 that the value "count2" is greater than the value B, in other words, the reference period of the brightness change pattern has reached its end timing (S702: Yes), the CPU 11 sets the hit timing flag 13*a* to OFF (S706), and the value of the hit moment brightness (bright2) is set to zero (S707). Therefore, after the reference period of the brightness change pattern reaches the end timing, the brightness change pattern is not referred to. Next, the CPU sets the value "count2" to zero (S708), and ends the present processing.

When it is judged in S701 that the hit timing flag 13*a* is OFF (S701: No), it is not in the reference period of a brightness change pattern, and therefore the CUP 11 proceeds the process to S707.

Figure 8A:
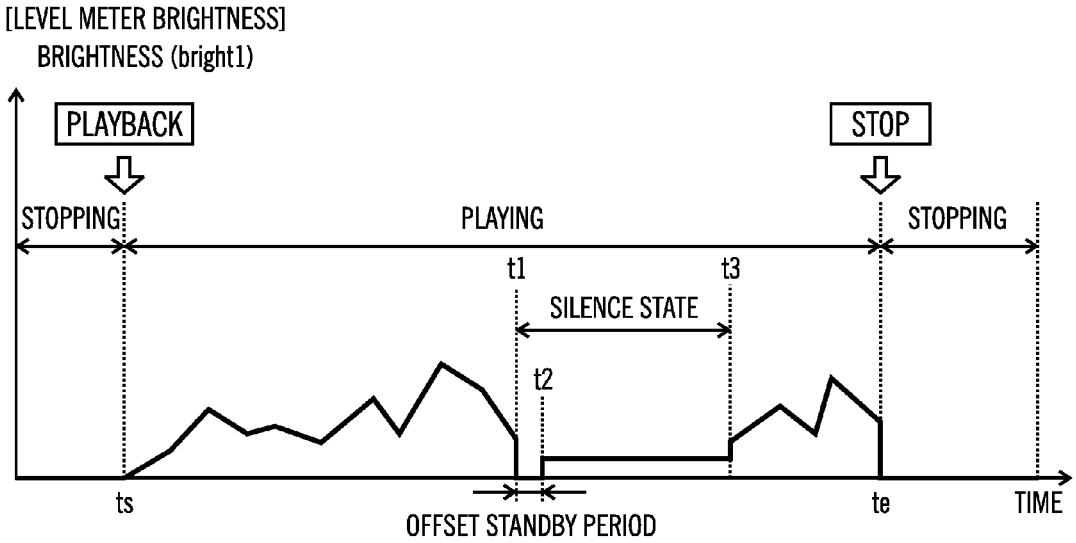
FIG. 8(*a*) is a graph showing an example of changes in level meter brightness of a single LED with time.
Figure 8B:
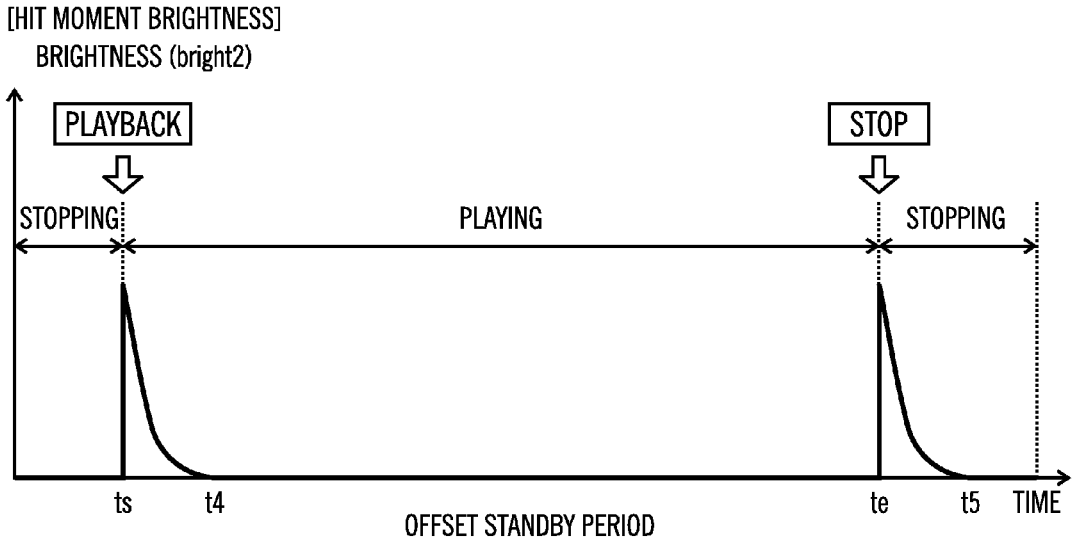
Figure 8C:
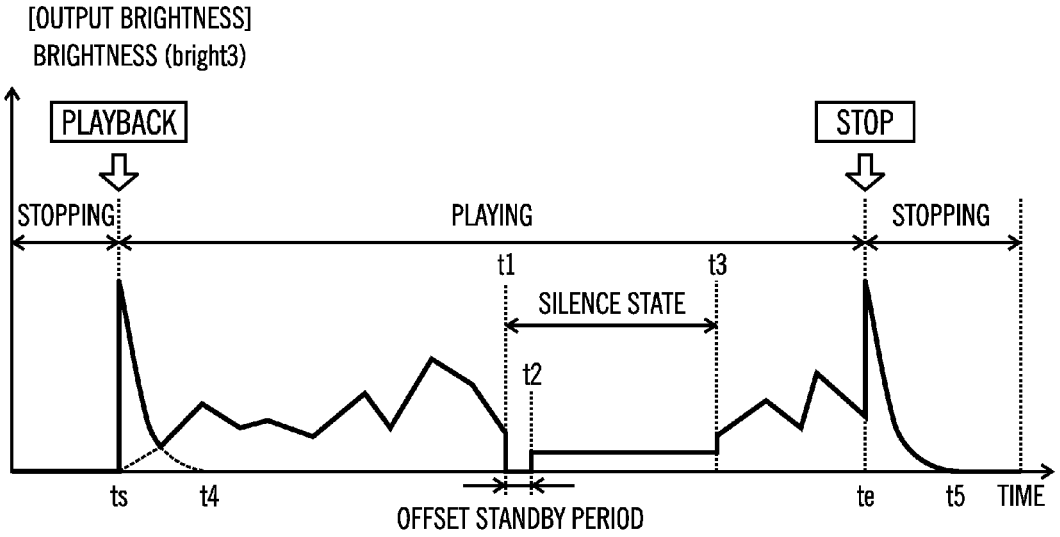

Next, referring to FIG. 8 and FIG. 9, changes in brightness of the LED 4 caused by the control (i.e., the processes shown in FIG. 3-FIG. 7) by the light emission control device 100 will be described. FIG. 8 shows graphs for describing examples of changes in brightness with time of one of the LEDs 4.

First, FIG. 8(*a*) is a graph showing one example of changes in the level meter brightness with time calculated by the level meter brightness calculation process (S501; see FIG. 6). In FIG. 8(*a*), the horizontal axis of the graph indicates time, and the vertical axis thereof indicates the level meter brightness (bright1).

When the user strikes the pad 3 at time ts while tone generation is stopped (in other words, when the playback flag is OFF), reproduction of a tone based on waveform data assigned to the pad 3 being struck is started. When reproduction of the tone is started, the level meter brightness (bright1) is set to brightness according to the level of the reproduced sound (i.e., the reproduced tone) at each moment.

During playback of the tone (in other words, while the playback flag is ON), when the level of the tone becomes zero at time t1, the level meter brightness (bright1) also becomes zero. Thereafter, if the level of the tone remains to be zero even when the offset standby period elapses from time t1 and reaches time t2, the level of the tone is forcefully set to an offset value. As a result, during the period starting from time t2 to time t3 at which the level of the tone changes to a level other than zero, the level meter brightness (bright1) is set to brightness corresponding to the offset value.

After time t3, the level meter brightness (bright1) is again set to brightness according to the level of the reproduced sound (i.e., the reproduced tone) at each moment. Then, when the user strikes the pad 3 at time te, the reproduction of the tone based on the waveform data assigned to the pad 3 being struck is stopped. By this, the level of the tone becomes zero, such that, after time te, the level meter brightness (bright1) is set to zero until the reproduction of a next tone is started.

FIG. 8(*b*) is a graph showing an example of changes in the hit moment brightness with time calculated by the hit moment brightness calculation process (S502; see FIG. 7). In FIG. 8(*b*), the horizontal axis of the graph indicates time, and the vertical axis thereof indicates the hit moment brightness (bright2).

When the user strikes the pad 3 at time ts while tone is stopped, reading of brightness is started according to a brightness change pattern stored in the hit moment brightness waveform memory 12*b*. Thereafter, brightness is successively read out according to the brightness change pattern, and the brightness read out at each moment is set as the hit moment brightness (bright2) until the reference period ends (in other words, until t4). After time t4, which is the end timing of the reference period, the hit moment brightness (bright2) is set to zero until the pad 3 is struck next time.

Thereafter, when the user strikes the pad 3 at time te during playback of the tone, reading of brightness is started according to the brightness change pattern stored in the hit moment brightness waveform memory 12*b*, in a manner similar to the case where the pad 3 was struck at time ts. Thereafter, brightness is successively read out according to the brightness change pattern, and the brightness read out at each moment is set as the hit moment brightness (bright2) until the reference period ends (in other words, until t5). After time t5, which is the end timing of the reference period, the hit moment brightness (bright2) is set to zero until the pad 3 is struck next time.

FIG. 8(*c*) is a graph showing an example of changes in the output brightness with time decided by the output brightness deciding process (S503; see FIG. 5). In FIG. 8(*c*), the horizontal axis of the graph indicates time, and the vertical axis thereof indicates the output brightness (bright3).

As described above, the output brightness (bright3) is decided based on the level meter brightness (bright1) and the hit moment brightness (bright2) at each moment. When the user strikes the pad 3 at time ts while tone is stopped, the output brightness (bright3) is preferentially decided to be the hit moment brightness (bright2) from time ts until the preferential period ends. It is noted that, in the example shown in FIG. 8, the level meter brightness (bright1) and the hit moment brightness (bright2) during the preferential period have a relation, bright2>bright1.

After the end of the preferential period until the reference period ends (in other words, until t4), the output brightness (bright3) is decided to be a higher one among the level meter brightness (bright1) and the hit moment brightness (bright2) at each moment.

During the period from time t4 until time te, the hit moment brightness (bright2) is not referred to, the output brightness (bright3) is decided to be the level meter brightness (bright1) at each moment. Therefore, when a silent state is present from time t1 to time t3 in the reproduced sound, the output brightness (bright3) is decided to be zero that is the level meter brightness (bright1) from the start timing of the silence state (time t1) until the end timing of the offset standby period (time t2). As described above, after time t2 at which the offset standby period ends until time t3, the level meter brightness (bright1) is set to brightness corresponding to the offset value. Therefore, from time t2 to time t3, the output brightness (bright3) is set to brightness corresponding to the offset value.

When the user strikes the pad 3 at time te, the output brightness (bright3) is decided to be the hit moment brightness (bright2) at each moment during the period from time te until the reference period ends (in other words, until time t5).

Figure 9:
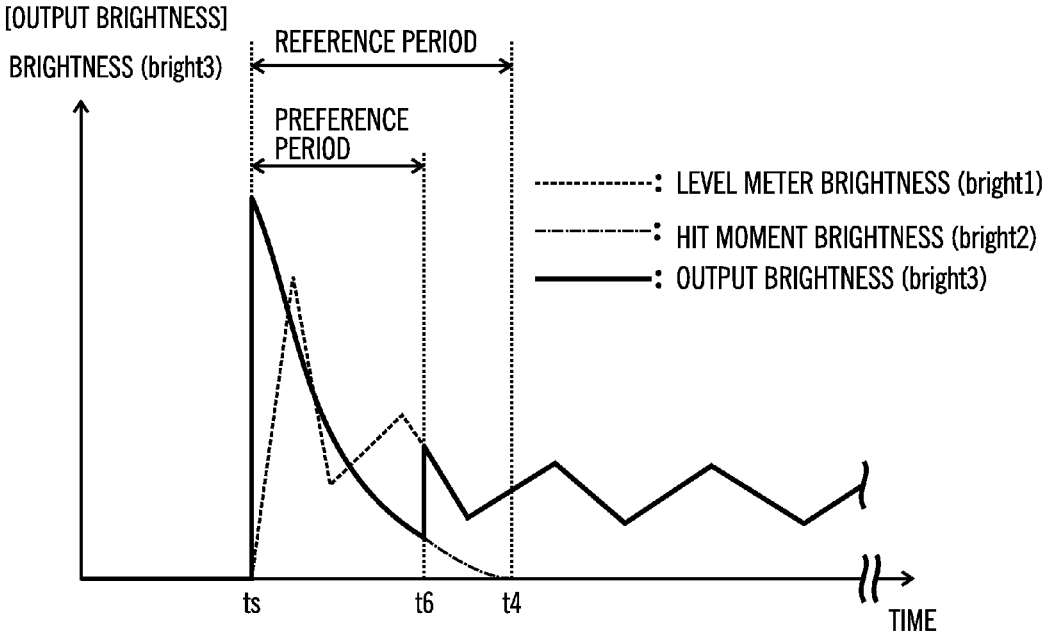
FIG. 9 is a graph providing an example of changes in brightness of a single LED with time.

FIG. 9 is a graph for describing an example of changes in the brightness with time of one of the LEDs 4. In FIG. 9, the horizontal axis of the graph indicates time, and the vertical axis thereof indicates the output brightness (bright3). A solid line in the graph of FIG. 9 indicates changes in the output brightness (bright3) with time. It is noted that a dotted line indicates changes in the level meter brightness (bright1) with time used for deciding the output brightness. A dot-and-dash line indicates changes in the hit moment brightness (bright2) with time used for deciding the output brightness. These brightness include portions that overlap the output brightness (bright3) indicated by a solid line.

In the example shown in FIG. 9, the level of a tone near the start of reproduction is high, such that a high value is also calculated as the level meter brightness (bright1) near the start of reproduction. If the output brightness (bright3) is decided to be a higher one of the level meter brightness (bright1) and the hit moment brightness (bright2) for a tone (waveform data) that has a high level meter brightness (bright1) near the start of reproduction like this example, it may be difficult for the user who visually observes the brightness change in the LED 4 to recognize that the brightness change derives from a brightness change in the hit moment brightness (bright2) that reaches a relatively high peak brightness in a short time, and therefore difficult to grasp the start timing of reproduction of the tone.

However, as described above, according to the light emission control device 100 in accordance with the present embodiment, during the preferential period (i.e., the period from time is until time t6), the output brightness (bright3) is decided to be the hit moment brightness (bright2) irrespective of the level meter brightness (bright1). Due to the control by the light emission control device 100 in accordance with the present embodiment, the user who visually observes the brightness change in the LED 4 can readily recognize that the brightness change derives from a brightness change in the hit moment brightness (bright2), and can therefore clearly grasp the start timing of reproduction of the tone.

As described above, in accordance with the described embodiments, based on the level meter brightness calculated from the level of a tone, the hit moment brightness calculated when the pad 3 is struck, and the states of the hit timing flag 13*a* and the playback flag 13*b*, the brightness of each of the LEDs 4 corresponding to the pad 3 being struck is set. In other words, the single LED 4 corresponding to the pad 3 being struck illuminates in an illumination mode by which the playback state of the tone (sound) can be distinguished and the level of the playback tone can be notified. By such control as described above, tone distinguishability by visual observation of the LED 4 can be improved.

For example, as shown in FIG. 8(*c*), when a silent state is included in reproduced tone, brightness according to the level of the actual tone (i.e., zero because it is silent) is decided as output brightness until the silence state reaches the offset standby period (150 msec in the present embodiment). Thereafter, when the silent state exceeds the offset standby period, brightness corresponding to a predetermined offset level is decided as output brightness. By this, when a silence state occurs during playback of a tone, the LED 4 does not illuminate (is lit out) until the silent state during the playback reaches a predetermined period (the offset standby period), but illuminates with a predetermined brightness level when the silent state exceeds the predetermined period, despite the fact that the silent state continues.

Therefore, if the LED 4 illuminates, the user can grasp that the tone is being reproduced even when no sound is heard. Also, the LED 4 changes its illumination from the non-illuminating state (in other words, zero brightness) to a brightness level corresponding to the offset value. Because of the presence of the brightness change, the user can clearly grasp that the silence state is occurring during playback of the tone.

Also, as shown in FIG. 9, when the user instructs to reproduce a tone by striking the pad 3, the hit moment brightness is preferentially (forcefully) decided as the output brightness during the predetermined preferential period from the start of the reproduction of the tone, irrespective of the level meter brightness. Therefore, the user can readily recognize that the change in brightness of the LED 4 is derived from a brightness change in the hit moment brightness (bright2), and therefore can clearly understand the start timing of the tone generation.

Also, when the user instructs to stop reproduction of a tone by striking the pad 3, the hit moment brightness is decided as being the output brightness. Therefore, the user can readily recognize that the change in brightness of the LED 4 is derived from a brightness change in the hit moment brightness (bright2). Accordingly, the stop timing of the tone being reproduced (the reproduction end timing) can be clearly grasped.

The invention has been described above with respect to the discussed embodiments. However, it can be readily presumed that the invention is not at all limited to the embodiment described above, and various changes and improvements can be made within the range that does not depart from the subject matter of the invention.

For example, the numerical values used in the embodiment described above are only an example, and in further embodiments other numerical values can also be used.

Also, the embodiments described above are configured such that, when a silence state is included in reproduced tone, brightness according to the level of the actual tone is decided to be the output brightness until the silence period reaches an offset standby period and, when the silence period exceeds the offset standby period, brightness according to a predetermined offset value is decided to be the output brightness. Instead of such a configuration, the offset standby period may not be provided, and brightness according to a predetermined offset value may be decided as the output brightness when the level of the tone during playback becomes zero.

Also, the embodiment described above is configured such that, when the value "level" is judged to be zero in S604 of the level meter brightness calculation process, the process proceeds to the step S605. However, it can be configured such that, when the value "level" is less than a predetermined value close to zero, the process may proceed to the step S605. In other words, the threshold value of the level of a tone that is judged to be a silence state during playback of the tone is not limited to zero, but may be a predetermined value close to zero.

Also, the embodiment described above is configured such that the playback level of a tone is modified according to the striking strength (the operation strength) on the pad 3. However, it can be configured such that a tone may be generated with a predetermined velocity regardless of the striking strength. When the playback level is not modified according to the striking strength, the striking strength may not have to be detected.

Further, the embodiment described above is configured such that the hit moment brightness is set, irrespective of the striking strength (the operation strength) on the pad 3. However, it can be configured such that the striking strength on the pad 3 may be reflected on the hit moment brightness.

Also, the embodiment described above is configured such that the brightness of the LED 4 is decided before the level of a tone based on waveform data is changed to a playback level according to the striking strength on the pad 3. However, it may be configured such that the brightness of the LED 4 is decided using a playback level that reflects the striking strength on the pad 3.

Also, the embodiment described above is configured such that the level of a tone is set to the maximum value of the wave height in a predetermined period (during the period of 50 msec that is an execution interval of the light emission control process). However, an average value of the wave heights during the predetermined period may be set as the level of the tone. Alternatively, an integrated value of the wave heights during the predetermined period may be set as the level of the tone.

Also, in the embodiment described above, the pads 3 are exemplified as operation elements for instructing to playback or to stop tones. However, the operation elements for instructing to playback or to stop tones are not limited to the pads 3, and various kinds of other operation elements that are capable of detecting operation timings can be used. For example, operation elements, such as, a keyboard, push buttons, lever switches and the like may be used.

Furthermore, the embodiment described above is configured to detect a striking on the pad 3 and to switch between starting tone playback and stopping tone playback each time a striking is detected. Instead, it may be configured to continue reproducing a tone as long as the operation element is operated. For example, when a keyboard is used as operation elements for instructing to playback or stop tones, it may be configured such that tones are continuously reproduced as long as keys of the keyboard are depressed, and reproduction of tones is stopped when the keys of the keyboard are released. In this case, the timing when a key on the keyboard is depressed is set as a playback timing of a tone, and the timing when the key on the keyboard is released is set as a stop timing of the tone.

Also, when a keyboard is used as operation elements for instructing to playback or stop tones, it may be configured such that, the stronger a key is depressed (or the faster a key is depressed), the higher the peak of brightness indicative of a tone playback start timing (corresponding to the hit moment brightness) becomes. On the other hand, it may be configured such that, the faster a key is released, the higher the peak of brightness indicative of a tone playback stop timing becomes.

Further, the embodiment described above is configured such that playback of a tone is started when the pad 3 (an operation element) is struck while tone reproduction is stopped, and playback of a tone is stopped when the pad 3 is struck while the tone is being reproduced. However, it may be configured such that playback of a tone is stopped without depending on an operation (striking) on the pad 3. In other words, it may be configured such that starting of tone playback is instructed by striking the pad 3, and the tone playback may be stopped at the time when the reproduced waveform data reaches its end point, as the stop timing. The end point of waveform data may be obtained from the length of the waveform data stored (recorded) in the waveform memories 12*c*, 13*c* and 14*a*.

When the configuration of stopping tone playback at the time when the waveform timing reaches its end point without operating the operation element is used, a configuration that does not calculate the hit moment brightness may be used for stopping tone playback.

Also, the embodiment described above is configured such that the light emission control device 100 is mounted on the electronic musical instrument 1 together with the pads 3. However, the light emission control device 100 may be configured as an independent device with respect to the pads 3. For example, pads to be struck by the user may be provided independently from a device having the light emission control device 100 and the LEDs 4 mounted thereon, and trigger signals generated upon striking the pads may be inputted in the light emission control device. Also, the light emission control device 100 may be provided independently from the drivers 21 and the LEDs 4.

Furthermore, the light emission control device 100 may be configured as an independent device separated from a unit that reproduces tones (i.e., the sound source, the DSP and the like). In this case, it may be configured such that the level of tones is inputted from the unit that reproduces tones to the light emission control device 100. The embodiment described above is configured such that the light emission control device 100 includes the DSP 19. However, if the light emission control device 100 is provided as an independent device separated from the unit that reproduces tones, the light emission control device 100 does not include the DSP 19.

Furthermore, in accordance with the embodiment described above, the brightness of the LED 4 is controlled such that the playback state of tones (sounds) and the level of playback tones can be distinguished. Objects to be controlled are not limited to the brightness, but other illumination modes (such as, for example, illumination colors of LEDs, blinking periods of LEDs and the like) may be controlled. For example, the LED 4 may be formed from a multicolor LED, and the illumination color of the LED 4 in a silence state during tone playback may be controlled to become different from an illumination color thereof generated when the level of tones is greater than zero. Moreover, playback or stopping of tones may be expressed by illuminating the LED 4 in an illumination color different from that generated at the level of playback tones. Alternatively, the level of playback tones may be expressed by changes in brightness of the LED, and the silence state during tone playback may be expressed by blinking (a blinking period) of the LED 4.

Also, in the embodiment described above, when the value "level" is converted to a brightness level in S607, a relational expression that establishes a linear relation between the value "level" and the brightness level is used for the conversion calculation. As the relational expression, a relational expression that establishes a non-linear relation between the value "level" and the brightness level may be used. Even when the value "level" and the brightness level are in a non-linear relation, changes visually observed may preferably be perceived as linear changes.

Also, the embodiment described above is configured such that the value "level" is converted into a brightness level by calculation in S607. However, a table that correlates values "level" with brightness levels in advance may be provided, and the table may be referred to for converting the value "level" to a brightness level.

In the embodiment described above, it is configured such that the level meter brightness is calculated once playback of a tone is started, regardless of whether or not it is in the preferential period. However, it may be configured not to calculate the level meter brightness during the preferential period.

Also, the embodiment described above is configured such that tones are reproduced based on waveform data stored in the storage sections (the ROM 11, the RAM 13 and the flash memory 14) provided within the electronic musical instrument 1. Waveform data to be reproduced are not limited to those stored in the storage sections provided within the electronic musical instrument 1, but may be those stored in removable recording media, such as, an SD card (registered trademark), a compact flash (registered trademark), a USB memory, and the like, and an external hard disk drive or the like.

The embodiment described above is configured such that the same brightness change pattern stored in the hit moment brightness waveform memory 12*b* is used at the time of starting playback and the time of ending playback. Instead, different brightness change patterns may be used at the time of starting playback and the time of ending playback, respectively. The "different brightness change patterns" may be brightness change patterns in which changes in brightness with time are mutually different at the time of starting playback and the time of ending playback but their reference periods are the same, brightness change patterns in which reference periods are mutually different at the time of starting playback and the time of ending playback, and the like.

Also, in the embodiment described above, the hit moment brightness is calculated using a brightness change pattern stored in advance in the hit moment brightness waveform memory 12*b*. However, a brightness change pattern of the hit moment brightness may be calculated by arithmetic operation. For example, the brightness change pattern may comprise an impulse waveform having a predetermined value at the start of the reference period that becomes 0 (zero) in the remaining period, a rectangular waveform having a predetermined value in the reference period that becomes 0 outside the reference period, and a saw tooth waveform having a predetermined value at the start of the reference period that becomes 0 (zero) at the end of the reference period or the like.

Also, in the embodiment described above, the preferential period is shorter than the reference period. However, the preferential period may have the same length as the reference period. In other words, the entire reference period may be made equal to the preferential period such that the reference period does not remain after the preferential period.

In the embodiment described above, the level acquiring process (S401) exemplifies the level information acquisition device. Step S301 exemplifies the playback start information acquisition device. Step S301 exemplifies the playback end information acquisition device. The light emission control process in FIG. 5 exemplifies the setting device. Steps S603: Yes, S604: No, and S607 exemplify the first setting device. Steps S603: Yes, S604: Yes, S605: Yes, and S607 exemplify the second setting device. The hit moment brightness waveform memory 12*b* exemplifies the brightness change pattern storage device. Steps S503*a*: Yes, S503*c*: Yes, and S503*d*: No exemplify the third setting device. Steps S503*a*: Yes, and S503*c*: No exemplify the fourth setting device.

What is claimed is:

1. A light emission control device, comprising:

a pad capable of being struck by a user to produce a sound;

a light emitter associated with the pad;

at least one computer readable memory storing a program and a brightness change pattern, wherein the brightness change pattern provides a brightness for the light emitter for a reference period, wherein the brightness change pattern provides different brightness values over time;

a processor executing the program to perform operations, the operations comprising:

detecting a striking of the pad;

producing a tone associated with the pad in response to the striking of the pad;

determining a level of the tone produced;

determining a level meter brightness based on the determined level of the tone;

calculating an output brightness for the light emitter associated with the struck pad using the determined level meter brightness and the brightness change pattern; and controlling the light emitter associated with the pad according to the determined output brightness by performing:

controlling the light emitter to illuminate with brightness according to the determined level of the tone produced in such a manner that the output brightness is zero when the level of the tone produced is zero and, the greater the level of the tone produced, the higher the brightness becomes; and controlling the single light emitter to illuminate with a predetermined brightness level unrelated to the level of the tone produced in a predetermined case where sound is being reproduced during a period since the striking of the pad is detected until playback end is detected and the level of the tone produced is zero or less than a predetermined value.

2. The light emission control device of claim 1, wherein the controlling the light emitter comprises controlling the light emitter to illuminate with brightness in the predetermined brightness level, in the predetermined case where sound is being reproduced, and a period in which the level of the one produced is zero or less than a predetermined value exceeds a predetermined time.

3. A light emission control device, comprising:

a pad capable of being struck by a user to produce a sound;

a light emitter associated with the pad;

at least one computer readable memory storing a program and a brightness change pattern, wherein the brightness change pattern provides a brightness for the light emitter for a reference period, wherein the brightness change pattern provides different brightness values over time;

a processor executing the program to perform operations, the operations comprising:

detecting a striking of the pad;

producing a tone associated with the pad in response to the striking of the pad;

determining a level of the tone produced;

determining a level meter brightness based on the determined level of the tone;

calculating an output brightness for the light emitter associated with the struck pad using the determined level meter brightness and the brightness change pattern; and controlling the light emitter associated with the pad according to the determined output brightness, wherein the calculated output brightness is based on the level of the tone produced, the detecting of the striking of the pad, and wherein detecting of a playback end causes the controlled light emitter to illuminate in an illumination mode that enables a playback state of the sound to be distinguished and the level of the sound reproduced to be notified.

4. The light emission control device of claim 3, wherein the controlling the light emitter comprises:

controlling the light emitter to illuminate with brightness according to the level of the tone produced in a manner that the brightness is zero when the level of the tone produced indicates zero and, the greater the level of the tone produced, the higher the brightness becomes; and controlling the light emitter to illuminate with brightness showing a predetermined brightness change, in the predetermined case where the playback end is detected.

5. A light emission control device, comprising:

a pad capable of being struck by a user to produce a sound;

a light emitter associated with the pad;

at least one computer readable memory storing a program and a brightness change pattern, wherein the brightness change pattern provides a brightness for the light emitter for a reference period, wherein the brightness change pattern provides different brightness values over time;

a processor executing the program to perform operations, the operations comprising:

detecting a striking of the pad;

producing a tone associated with the pad in response to the striking of the pad;

determining a level of the tone produced;

determining whether a predetermined time has elapsed since the pad was struck;

controlling the light emitter to illuminate with brightness according to a level meter brightness in response to the predetermined time having elapsed since the pad was struck, wherein the level meter brightness is based on the determined level of the tone; and controlling the light emitter to illuminate with brightness according to a hit moment brightness in response to the predetermined time having not elapsed since the pad was struck, wherein the hit moment brightness is determined from the brightness change pattern according to time that has elapsed since the pad was struck.

6. The light emission control device of claim 5, wherein the controlling the light emitter comprises:

controlling the light emitter to illuminate with brightness in a manner that the output brightness is zero when the level of the tone produced is zero and, the greater the level of the tone produced, the higher the brightness becomes.

7. The light emission control device of claim 5, wherein there are a plurality of pads and for each pad an associated light emitter, wherein the operations of the detecting the striking of the pad, the producing the tone, the determining the level, the controlling the light emitter to illuminate with brightness according to the level meter brightness or the hit moment brightness are performed for each of the pads when each of the pads is struck.

8. The light emission control device of claim 5, wherein the operations further comprise:

determining whether a preferential period has elapsed since the pad was struck in response to determining that the tone is being reproduced, wherein the preferential period is less than or equal to the predetermined time, and wherein the light emitter is controlled to illuminate according to the hit moment brightness in response to further determining that the preferential period has not elapsed.

9. The light emission control device of claim 8, wherein the operations further comprise:

determining whether the level meter brightness is greater than the hit moment brightness in response to determining that tone is being reproduced while the measured time is not within the preferential period, wherein the light emitter is controlled to illuminate according to the hit moment brightness in response to determining that the level meter brightness is not greater than the hit moment brightness and wherein the light emitter is controlled to illuminate according to the level meter brightness in response to determining that the level meter brightness is greater than the hit moment brightness.

10. The light emission control device of claim 5, wherein the determining the hit moment brightness comprises:

setting the hit moment brightness to zero in response to determining that the predetermined time has elapsed; and in response to determining that the predetermined time has not elapsed, performing:

determining a brightness level corresponding to the measured period from a hit moment brightness waveform; and setting the hit moment brightness to the determined brightness level.

11. The light emission control device of claim 5, wherein determining the level meter brightness comprises:

determining whether the tone has been reproduced with a level of zero for a predetermined offset period;

setting the level meter brightness to zero in response to determining that the tone has been reproduced with the level of zero for less than the predetermined offset period; and setting the level meter brightness to a predetermined brightness value in response to determining that the tone has been reproduced with the level of zero for more than the predetermined offset period.

12. The light emission control device of claim 5, wherein determining the level meter brightness further comprises:

determining whether the tone has been reproduced with a level of zero; and setting the level meter brightness to a brightness value based on a level of the tone being reproduced in response to determining that the level of the tone is not zero, wherein the brightness value increases as the level of the tone increases.

13. The light emission control device of claim 5, wherein the operations further comprise:

determining whether a tone is being reproduced for the pad in response to detecting the striking of the pad, wherein the operations of the controlling the light emitter are performed in response to determining that the tone is not being reproduced for the pad; and stopping the playing of the tone in response to determining that the tone is being reproduced for the pad.

14. A light emission control device, comprising:

a pad capable of being struck by a user to produce a sound;

a light emitter associated with the pad;

at least one computer readable memory storing a program and a brightness change pattern, wherein the brightness change pattern provides a brightness for the light emitter for a reference period, wherein the brightness change pattern provides different brightness values over time;

a processor executing the program to perform operations, the operations comprising:

detecting a striking of the pad;

producing a tone associated with the pad in response to the striking of the pad;

determining a level of the tone produced;

determining whether a tone is being reproduced for the pad in response to detecting the striking of the pad;

in response to determining that the tone is not being reproduced for the pad performing:

determining a level meter brightness based on the determined level of the tone;

calculating an output brightness for the light emitter associated with the struck pad using the determined level meter brightness and the brightness change pattern; and controlling the light emitter associated with the pad according to the determined output brightness; and stopping the playing of the tone in response to determining that the tone is being reproduced for the pad.

15. A method, comprising:

detecting a striking of a pad;

producing a tone associated with the pad in response to the striking of the pad;

determining a level of the tone produced;

determining whether a predetermined time has elapsed since the pad was struck;

controlling the light emitter to illuminate with brightness according to a level meter brightness in response to the predetermined time having elapsed since the pad was struck, wherein the level meter brightness is based on the determined level of the tone; and controlling the light emitter to illuminate with brightness according to a hit moment brightness in response to the predetermined time having not elapsed since the pad was struck, wherein the hit moment brightness is determined from a brightness change pattern according to time that has elapsed since the pad was struck.

16. The method of claim 15, wherein there are a plurality of pads and for each pad an associated light emitter, wherein the operations of the detecting the striking of the pad, the producing the tone, the determining the level, and the controlling the light emitter to illuminate with brightness according to the level meter brightness or the hit moment brightness are performed for each of the pads when each of the pads is struck.

17. The method of claim 15, wherein the operations further comprise:

determining whether a preferential period has elapsed since the pad was struck in response to determining that the tone is being reproduced, wherein the preferential period is less than or equal to the predetermined time, and wherein the light emitter is controlled to illuminate according to the hit moment brightness in response to further determining that the preferential period has not elapsed.

18. The method of claim 17, wherein the operations further comprise:

determining whether the level meter brightness is greater than the hit moment brightness in response to determining that tone is being reproduced while the measured time is not within the preferential period, wherein the light emitter is controlled to illuminate according to the hit moment brightness in response to determining that the level meter brightness is not greater than the hit moment brightness, and wherein the light emitter is controlled to illuminate according to the level meter brightness in response to determining that the level meter brightness is greater than the hit moment brightness.

19. The method of claim 15, wherein the determining the hit moment brightness comprises:

setting the hit moment brightness to zero in response to determining that the predetermined time has elapsed; and in response to determining that the predetermined time has not elapsed, performing:

determining a brightness level corresponding to the measured period from a hit moment brightness waveform; and setting the hit moment brightness to the determined brightness level.

20. The method of claim 15, wherein the determining the level meter brightness comprises:

determining whether the tone has been reproduced with a level of zero for a predetermined offset period;

setting the level meter brightness to zero in response to determining that the tone has been reproduced with the level of zero for less than the predetermined offset period; and setting the level meter brightness to a predetermined brightness value in response to determining that the tone has been reproduced with the level of zero for more than the predetermined offset period.

21. The method of claim 15, wherein the determining the level meter brightness further comprises:

determining whether the tone has been reproduced with a level of zero;

setting the level meter brightness to a brightness value based on a level of the tone being reproduced in response to determining that the level of the tone is not zero, wherein the brightness value increases as the level of the tone increases.

22. The method of claim 15, further comprising:

determining whether a tone is being reproduced for the pad in response to detecting the striking of the pad, wherein the operations of the controlling the light emitter are performed in response to determining that the tone is not being reproduced for the pad; and stopping the playing of the tone in response to determining that the tone is being reproduced for the pad.

23. A method, comprising:

detecting a striking of a pad;

producing a tone associated with the pad in response to the striking of the pad;

determining a level of the tone produced;

determining whether a tone is being reproduced for the pad in response to detecting the striking of the pad;

in response to determining that the tone is not being reproduced for the pad, performing:

determining a level meter brightness based on the determined level of the tone;

calculating an output brightness for the light emitter associated with the struck pad using the determined level meter brightness and a brightness change pattern;

controlling a light emitter associated with the pad according to the determined output brightness; and stopping the playing of the tone in response to determining that the tone is being reproduced for the pad.

* * * * *

UNITED STATES PATENT AND TRADEMARK OFFICE

CERTIFICATE OF CORRECTION

PATENT NO. : 8,937,239 B2
APPLICATION NO. : 13/490391
DATED : January 20, 2015
INVENTOR(S) : R. Takasaki et al.

It is certified that error appears in the above-identified patent and that said Letters Patent is hereby corrected as shown below:

In the Claims:

Column 23, Lines 34-35, “the operations of the detecting” should read --the detecting--.

Column 23, Lines 39-40, “wherein the operations further comprise:” should read --further comprising:--.

Column 23, Lines 49-50, “wherein the operations further comprise:” should read --further comprising:--.

Column 24, Lines 57-58, “brightness change pattern;” should read --brightness change pattern; and--.

Signed and Sealed this
Twenty-eighth Day of April, 2015

Michelle K. Lee

Michelle K. Lee
*Director of the United States Patent and Trademark Office*